US009763300B2

(12) United States Patent
O'Neil et al.

(10) Patent No.: US 9,763,300 B2
(45) **Date of Patent: *Sep. 12, 2017**

(54) PROGRAMMABLE LED DRIVER WITH MESH NETWORK WIRELESS INTERFACE

(71) Applicant: EPTronics, Inc., Gardena, CA (US)

(72) Inventors: Tom O'Neil, Torrance, CA (US); Lee Chiang, Sylmar, CA (US)

(73) Assignee: EPTRONICS, INC., Gardena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/366,805

(22) Filed: Dec. 1, 2016

(65) Prior Publication Data

US 2017/0086272 A1 Mar. 23, 2017

Related U.S. Application Data

(63) Continuation-in-part of application No. 14/812,073, filed on Jul. 29, 2015, now Pat. No. 9,544,951.

(51) Int. Cl.
*H05B 33/08* (2006.01)
*H05B 37/02* (2006.01)

(52) U.S. Cl.
CPC ..... *H05B 33/0845* (2013.01); *H05B 33/0809* (2013.01); *H05B 33/0884* (2013.01); *H05B 37/0227* (2013.01); *H05B 37/0272* (2013.01)

(58) Field of Classification Search
None
See application file for complete search history.

(56) References Cited

U.S. PATENT DOCUMENTS 9,544,951 B1 * 1/2017 O'Neil ..... H05B 33/0809
2014/0361701 A1 * 12/2014 Siessegger ..... H05B 33/0803 315/200 R

* cited by examiner

*Primary Examiner* — Dedei K Hammond
(74) *Attorney, Agent, or Firm* — Clement Cheng

(57) ABSTRACT

An LED driver includes a first stage. The first stage converts AC power from an AC power source into a DC power source. The driver also includes a second stage that receives the DC power from the first stage. The driver has a buck converter with a constant current output. The buck converter is managed by a buck converter control chip. The buck converter control chip is controlled by a microprocessor with an associated EEPROM. The EEPROM stores settings for the LED driver can be changed either with a wired GUI port or wirelessly through a Zigbee interface. The microprocessor can select a value of a DC output current according to a value of the analog dimming input signal which has been translated using a predetermined programmable relationship between the input signal and the output current.

8 Claims, 6 Drawing Sheets

PROGRAMMABLE LED DRIVER WITH MESH NETWORK WIRELESS INTERFACE

CROSS-REFERENCE TO RELATED APPLICATIONS

This application is a continuation-in-part of copending U.S. application Ser. No. 14/812,073 entitled Programmable LED Driver, filed Jul. 29, 2015, by the same inventors Tom O'Neil and Lee Chiang, the disclosure of which is herein incorporated by reference.

BACKGROUND OF THE INVENTION

Field of the Invention

This application relates in general to LED drivers the characteristics of which can be adjusted after manufacture, either by connecting a graphic user interface, by attaching programming resistors or by means of a Zigbee wireless interface.

Description of the Related Art

According to its Wikipedia article, "ZigBee is an IEEE 802.15.4-based specification for a suite of high-level communication protocols used to create personal area networks with small, low-power digital radios. The technology defined by the ZigBee specification is intended to be simpler and less expensive than other wireless personal area networks (WPANs), such as Bluetooth or Wi-Fi. Applications include wireless light switches, electrical meters with in-home-displays, traffic management systems, and other consumer and industrial equipment that requires short-range low-rate wireless data transfer."

A variety of different LED drivers are wirelessly programmable. U.S. Pat. No. 8,575,851 Entitled Programmable LED Driver by Bahrehmand describes a programmable LED driver which has a microprocessor with an EEPROM, (electrically erasable programmable read only memory) a buck converter, a wireless interface and can be adjusted in the field, the disclosure of which is incorporated herein by reference. However Bahrehmand lacks over temperature protection, and cannot be programmed by external resistors, does not have a DC (analog) output and does not have a 0-10 V (analog) input. U.S. Pat. No. 7,038,399 by Lys entitled Methods And Apparatus For Providing Power To Lighting Devices describes a programmable LED driver with a microprocessor which has an EEPROM, is field programmable, has a wireless interface, an analog dimming input, and a programmable dimming curve, the disclosure of which is incorporated herein by reference. However Lys does not describe the use of Zigbee, has no over temperature protection, does not use a buck converter, does not have DC output and cannot be field programmed with external resistors. U.S. Pat. No. 8,525,446 by Tikkanen entitled Configurable LED Driver/Dimmer For Solid State Lighting Applications describes a programmable LED driver which has a microprocessor, a buck converter and a ROM (read only memory) to store instructions. Tikkanen mentions a Zigbee interface and describes a DC (analog) output, the disclosure of which is incorporated herein by reference. However Tikkanen cannot be programmed either with resistors or with a graphical user interface, does not have an analog dimming input control, does not have a programmable dimming response curve and does not have over temperature protection.

SUMMARY OF THE INVENTION

The present invention is a programmable LED driver with DC output which comprises a buck converter, a microprocessor and an EEPROM, is field programmable either through a Zigbee interface or a graphic user interface or through external resistors, has a programmable dimming response curve and has over temperature protection. While not intending to limit the scope of the claims or disclosure, in brief summary, the present disclosure and claims are directed towards an LED driver with a buck converter which has characteristics which can be programmed and stored by various means in the field, and despite having a digital microprocessor internally has an analog (0-10 V) control input and a DC output to the LEDs being driven, and having over temperature protection.

The invention includes an LED driver which comprises two power converter stages. A first flyback stage converts AC power from an AC power source into a DC power source. Then a second stage receives the DC power from the first stage and consists of a step-down buck converter with a constant current output. The buck converter is controlled by a buck converter control chip. A microprocessor provides input command signals to the buck converter control chip. The purpose of the microprocessor, which has an associated EEPROM chip to store settings, is to allow the user to adjust the settings such as for example the dimming curve and the maximum output current and for these settings to be stored until reset.

The buck converter control chip includes multiple input/output (I/O) pins that communicate with the microprocessor. The microprocessor reads a user supplied resistor Rset the value of which sets the maximum output current to the LEDs, and also reads the value of a negative temperature coefficient (NTC) resistor which is used to represent the temperature of the assembly. Programming in the firmware uses the value of the NTC resistor as a basis to throttle back the output power so that the temperature of the assembly is limited. The microprocessor also reads a 0-10 VDC analog dimming signal which controls the output current according to a chosen dimming response curve. The way that this is done is that in response to the value of the Rset resistor and the analog (0-10 V) dimming control signal, the microprocessor outputs a pulse width modulation (PWM) signal. This is then filtered by an RC filter into a DC level that is provided to the buck converter control chip "IADJ" pin in order to set the output current. The firmware in the microprocessor can convert the incoming 0-10 V dimming signal according to a dimming response curve chosen from one of four stored options.

The setup data which is stored in the EEPROM chip can be adjusted either by directly connecting a graphical user interface (GUI) or by using a wireless Zigbee interface which can wirelessly connect to a Zigbee master unit which may in turn connect to a GUI somewhere else on the internet.

Disclosed and claimed in a first embodiment of the invention, an LED driver has AC input from the power line, and uses a buck converter with a buck converter control chip to produce a constant current DC output. A 0-10 V analog dimming input connects to a microprocessor embodied in the driver and the microprocessor translates this signal according to a predetermined dimming response curve and conveys this information to the buck converter control chip so as to control the DC output current of the driver.

Disclosed and claimed in a second embodiment of the invention, the LED driver is like the first embodiment but has a resistor connected which controls the maximum output current that can be commanded.

Disclosed and claimed in a third embodiment of the invention, the LED driver is like the second embodiment but has an additional NTC (negative temperature coefficient) resistor connected to the microprocessor and the microprocessor is programmed to reduce the output power in response to increased temperature sensed by the NTC resistor in such a manner that a chosen maximum temperature is never exceeded.

Disclosed and claimed in a fourth embodiment of the invention, the LED driver is like the third embodiment but has an EEPROM chip associated with the microprocessor which contains set up information of the driver. The EEPROM chip in turn is connected to a GUI port which allows the set up to be changed at will.

Disclosed and claimed in a fifth embodiment of the invention, the LED driver is like the fourth embodiment but additionally has a Zigbee module allowing the EEPROM chip to be programmed wirelessly.

Disclosed and claimed in a sixth embodiment of the invention, the LED driver is like the fourth embodiment, however the set up information in the EEPROM contains a plurality of predetermined relationships between the 0-10 V control signal and the output current.

Disclosed and claimed in a seventh embodiment of the invention, the LED driver is like the fifth embodiment, however the set up information in the EEPROM contains a plurality of predetermined relationships between the input control signal and the output current.

Disclosed and claimed in an eighth embodiment of the invention, the LED driver is like the fourth embodiment, however the EEPROM contains parameters which determine how the output current relates to the temperature sensed by the NTC resistor.

Disclosed and claimed in a ninth embodiment of the invention, the LED driver is like the fifth embodiment, however the EEPROM contains parameters which determine how the output current relates to the temperature sensed by the NTC resistor.

Other features and advantages of the present invention will become apparent from the following description of the invention that refers to the accompanying drawings.

Figure 1:
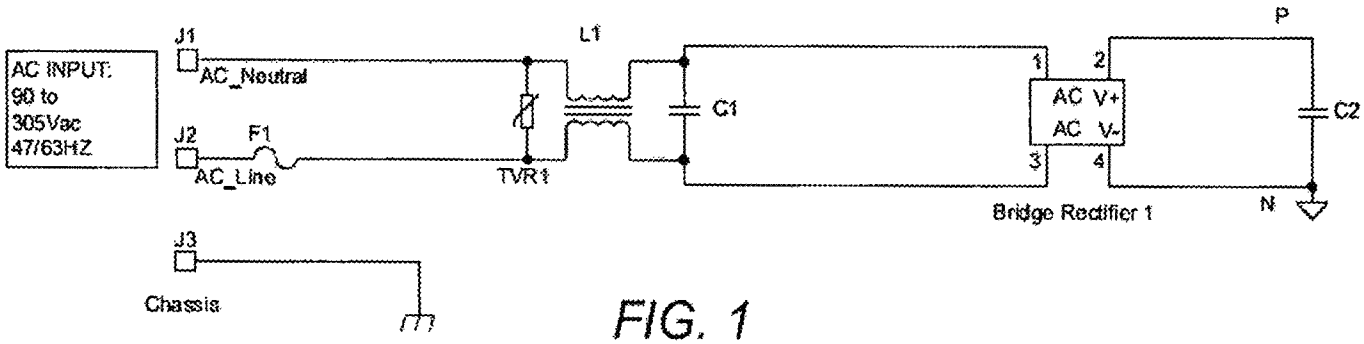
FIG. 1 is a circuit diagram of the present invention showing a general overview of the AC side of the circuit from the AC input to the bridge rectifier.

The following call out list of elements can be a useful guide in referencing the element numbers of the drawings. The callout list of elements is presented generally in the order that the elements are shown in the drawings.

101 Transition-Mode PFC Controller U2 STMicroelectronics™ part number L6562
102 Buck converter control chip U1 such as Texas Instruments™ part number TPS92640
106 IADJ pin on U1 for output current (I) adjustment
107 Analog Dim Signal (wire continues across figures)
108 PWM Dim Signal (wire continues across figures)
109 RC network
110 external LED load
116 UDIM pin on the LED driver U1 chip
117 LED+_OUT LED positive output terminal at connector J4
128 Riadj1 first current adjusting resistor
129 Riadj3 third current adjusting resistor
130 U1 VREF pin Reference Voltage Pin
131 Riadj2 second current adjusting resistor
134 U1 VOUT pin, a Voltage Reference Pin
135 first voltage output resistor Rvout1
136 second voltage output resistor Rvout2
103 +3.3 VDC voltage regulator U3
104 EEPROM U5 such as STMicroelectronics™ part number M24C02WP.
105 microprocessor U4 such as ST Microelectronics™ part number STM32F030F4P6
115 analog_dimming
118 Rvout3 voltage divider top resistor
119 Rvout4 voltage divider bottom resistor
120 Rvout5 low pass filter resistor
121 Cvout_sense low pass filter capacitor
122 Vout_Sense Sensing Output Voltage
132 Dvee VEE voltage isolation Diode
137 R_Dimming (from FIG. 4 top side of cap Crset)
139 Dntc1 protection diode
138 Rntc1 pull up resistor
133 NTC negative temperature coefficient resistor (temperature sensor)
140 Cntc Noise Filter for NTC_P output to processor
123 Rset LED current programming set resistor
124 Rrset1 pull up resistor
125 Rrset2 low-pass filter resistor
126 Crset low-pass filter capacitor
111 analog dim (0-10 VDC)
112 Radim2 voltage divider top resistor
113 Radim3 voltage divider bottom resistor
114 Cadim noise filter
150 wireless mesh network ZigBee module
151 wireless mesh network antenna
152 SCL serial clock for I2C interface
153 SDA serial data for I2C interface Glossary of Labels Used in the Drawings TVR1: Transient Voltage Suppressor. To absorb any high voltage spikes coming from the AC power line, such as from switching of high power devices nearby.
L1: common mode choke
F1: Fuse on the AC line to protect circuitry.
C1: capacitor across the AC power lines to filter some noise on the AC lines.
P: A netlist name assigned as "P", to indicate the "positive" high voltage after the bridge rectifier 1.
N: A netlist name assigned as "N", to indicate the "negative" high voltage after the bridge rectifier 1.
TI: an abbreviation for Texas Instruments™, a semiconductor manufacturer Abbreviations Used in the Specification LED light emitting diode
GUI graphical user interface
MCU microprocessor
USB Universal serial bus
NTC negative temperature coefficient
PFC power factor correction
THDi current (i) total harmonic distortion
THD total harmonic distortion PWM pulse width modulation
IADJ current adjustment terminal of the buck control chip
EEPROM electrically erasable programmable read-only memory
SDA serial data
SCL serial clock
ADC analog-to-digital converter
POC programmable output current
I2C or I2C a multi-master bus, which means that multiple chips can be connected to the same
bus and each one can act as a master by initiating a data transfer.
RC network resistor/capacitor network
I/O input/output

DETAILED DESCRIPTION OF THE INVENTION

The present invention is a programmable LED driver. FIG. 1 shows the AC side of the device up to immediately after the bridge rectifier. The LED driver has various standard components such as a common mode choke L1, with 2 windings in opposite directions on the same core, to block common mode switching noise from getting on the AC power lines for use as a standard electro-magnetic interference (EMI) filter. The Bridge Rectifier 1 provides a positive and negative voltage to P and N on the circuit diagram. The P and N of FIG. 1 are the same points as the P and N of FIG. 2 and could be physically embodied as wire solder junctions.

Figure 2:
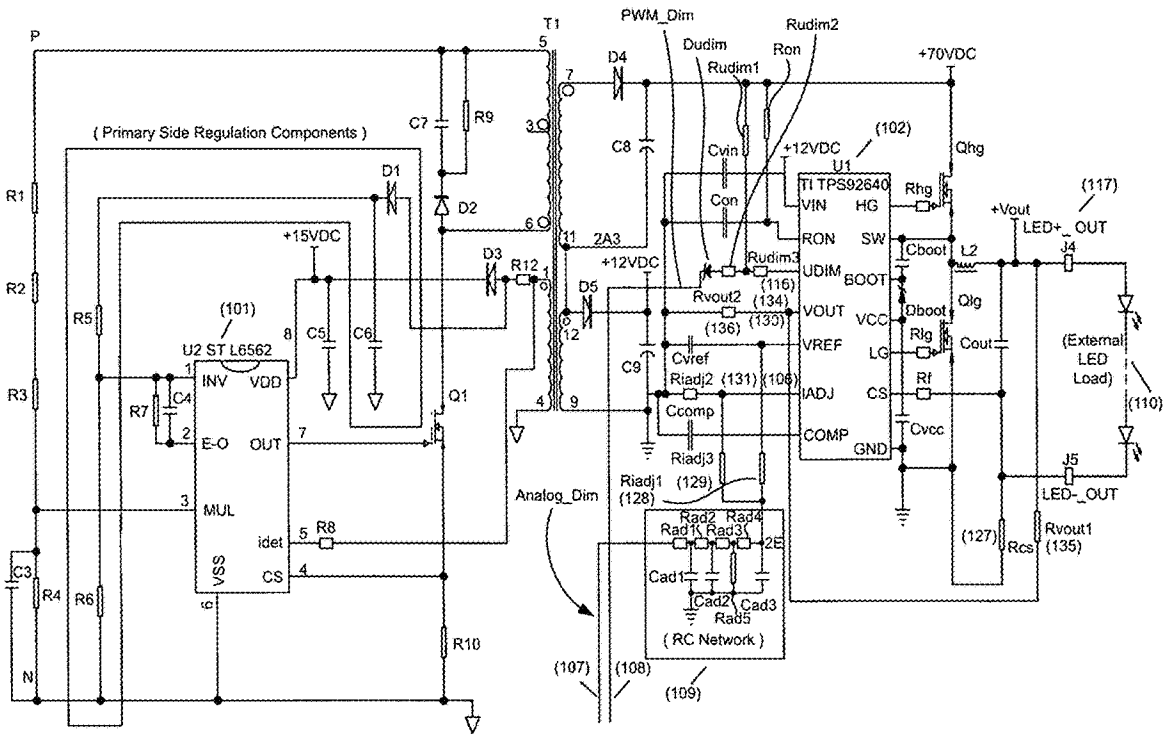
FIG. 2 is a circuit diagram of the present invention showing the DC side and including features such as a flyback PFC Controller for the primary side, and a second stage buck converter control chip.

The design is implemented in two stages, shown in FIG. 2. The first stage is a constant voltage flyback switching power supply powered by an AC power source from 90 to 305 VAC at 47 to 63 Hz input. The first stage design uses a flyback power factor correction chip U2 101 such as STMicroelectronics™ part number L6562 which has high power factor correction (PFC) and low AC current total harmonics distortion (THDi). The output DC voltage will be the main power source of the second stage, which is a step-down buck converter in constant current mode. The second stage buck controller chip U1 102 can be Texas Instruments™ part number TPS92640 that has both analog and digital dimming input signals. The dimming and programmable functions are implemented in the second stage. The buck controller chip is controlled with a microprocessor U4 105 (for example STMicroelectronics part number STM32F030F4P6) for multiple programmable features which are explained below.

The buck controller chip U1 102 is designed to dim the LED output using a standard pulse width modulation (PWM) signal 108 applied on the UDIM pin 116. However, in this invention this is not done and the UDIM pin is only used for shutdown of the output. The buck controller chip U1 102 dims the LED output by an analog signal applied on the IADJ pin. The microprocessor U4 105 (FIG. 3) with firmware sends a PWM signal Analog_Dim 107 to a resistor/capacitor network (RC Network 109), which integrates the signal into an analog signal, which is then fed to the IADJ pin 106 of chip 102 to dim the output.

The microcontroller U4 105 may have proprietary firmware and have a variety of input/output pins to handle proper GUI input signals and output analog dimming (Analog_Dim 107) signals to the buck converter control chip U1 102. The LED output maximum current is determined by a current sense resistor Rcs 127, which is in series with External LED load 110 to ground. The voltage across the current sense resistor Rcs 127 is connected to the buck converter chip U1 102 at a pin named CS via a feedback resistor Rf. The buck converter chip U1 102 internal error amplifier will maintain the voltage across the current sense resistor Rcs 127 at a predetermined voltage of 0.254 VDC in order to keep the LED current feedback loop closed. Therefore, the current through the External LED load 110 will be equal to 0.254 VDC divided by the value of the current sense resistor Rcs 127.

In the EEPROM of microprocessor U4 105 which can be either external in U5 104 or internal in U4 105, a table contains registered default settings of all the programmable parameters, such as the max Vdim voltage for reaching a hardware designed maximum LED output current as described above. The table can also have a minimum LED current dimming ratio.

Figure 4:
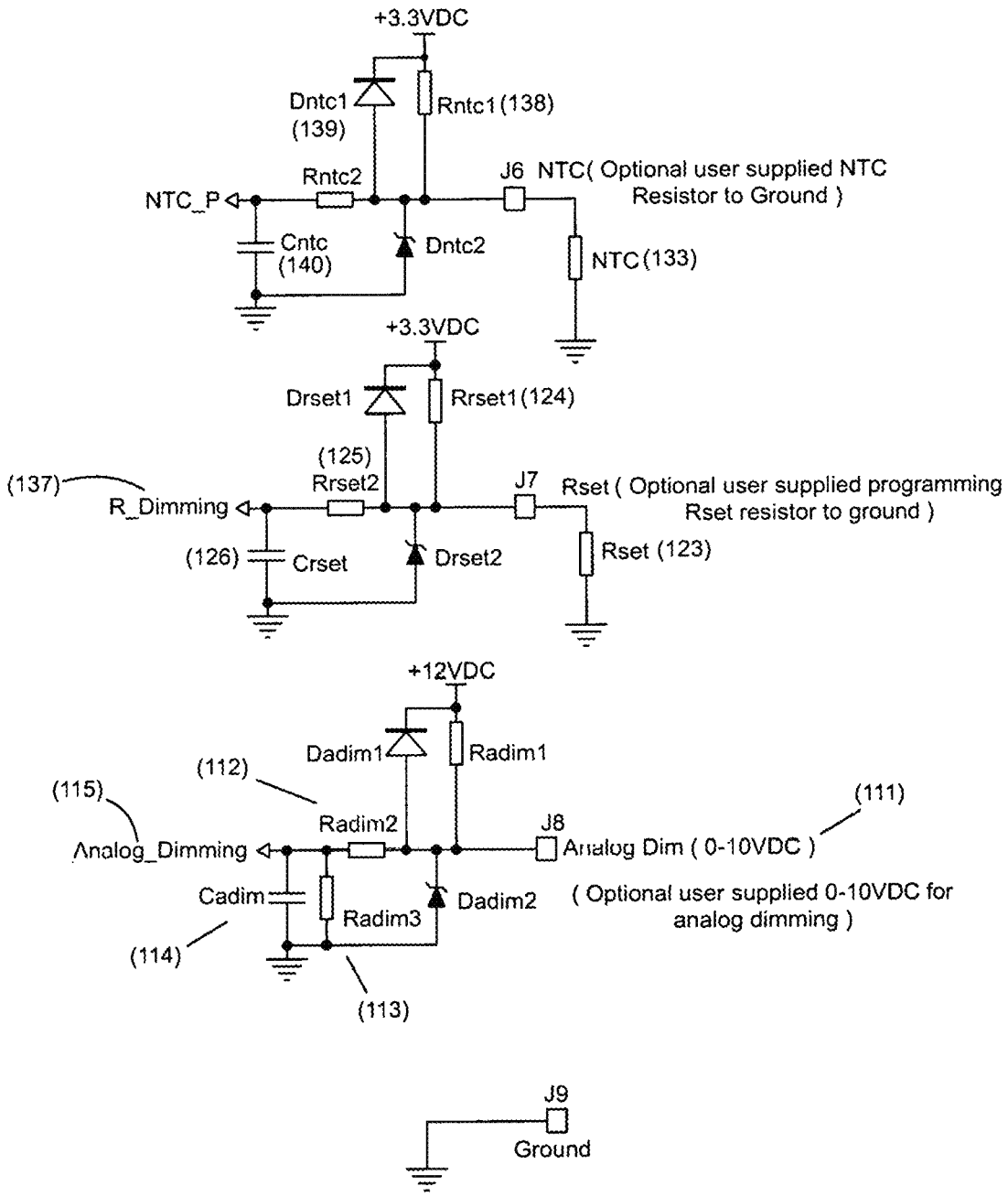
FIG. 4 is a circuit diagram of input ports for providing dimming inputs to the microprocessor.

FIG. 4 shows how the 0-10 VDC Vdim input signal, Analog Dim (0-10 V DC) 111, is divided down below 3.3 VDC to become signal Analog_Dimming 115 using a pair of resistors Radim2 112 and Radim3 113 and fed to the Microcontroller U4 105 analog input pin PA. The firmware in the microprocessor converts the input signal into digital data via an internal built-in analog-to-digital converter (ADC). Using the digital data information, the firmware can calculate the proper PWM signal according to the pre-calculated table for linear/logarithm/s-curve/inverse dimming curves. This PWM signal is output on pin PA7 (108) and then sent to the RC network 109 to generate the desired analog dimming signal for IADJ input pin 106 of the buck converter control chip U1 102 to implement the 0-10 VDC dimming.

Figure 3:
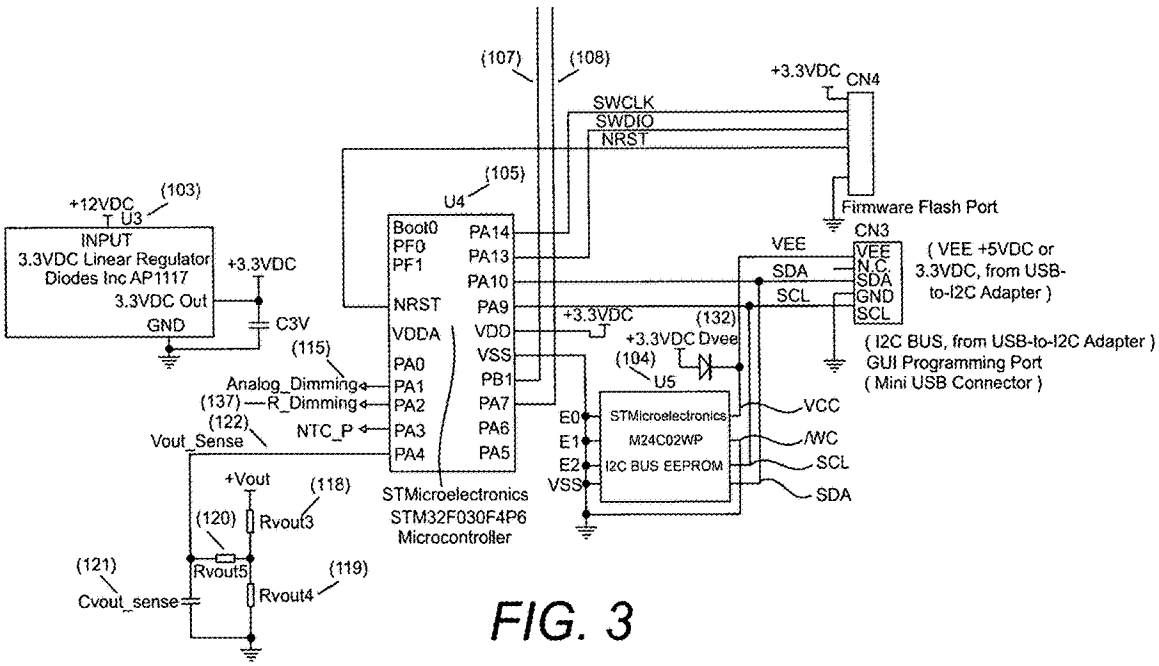
FIG. 3 is a circuit diagram of the present invention showing the microprocessor and the configuration for the programming and signals including features such as the configurable EEPROM that provides a memory for storage of various preconfigured settings.

As already remarked above, although a buck control chip like the one used here could provide PWM dimming, in this invention the PWM dimming pin UDIM is only used to shut down the output. The invention provides only the more desirable DC output current controlled by the voltage on U1 pin IADJ. The PWM_Dim signal 108 is used to shutdown the LED output by setting the PWM_Dim signal 108 at logic 0 or 0 VDC continuously when U4 105 pin PA4 (Vout_Sense 122) reads as too high, which means LED output voltage at +Vout is in a state of overvoltage. As seen in FIG. 3, the +Vout voltage is divided down to below 3.3 VDC using a pair of resistors Rvout3 118 and Rvout4 119. The +Vout voltage is then filtered by low-pass RC filter resistor Rvout5 120 and capacitor Cout_sense 121, and the signal Vout_Sense 122 is fed to the Microcontroller U4 105 analog input pin PA4.

Figure 5:
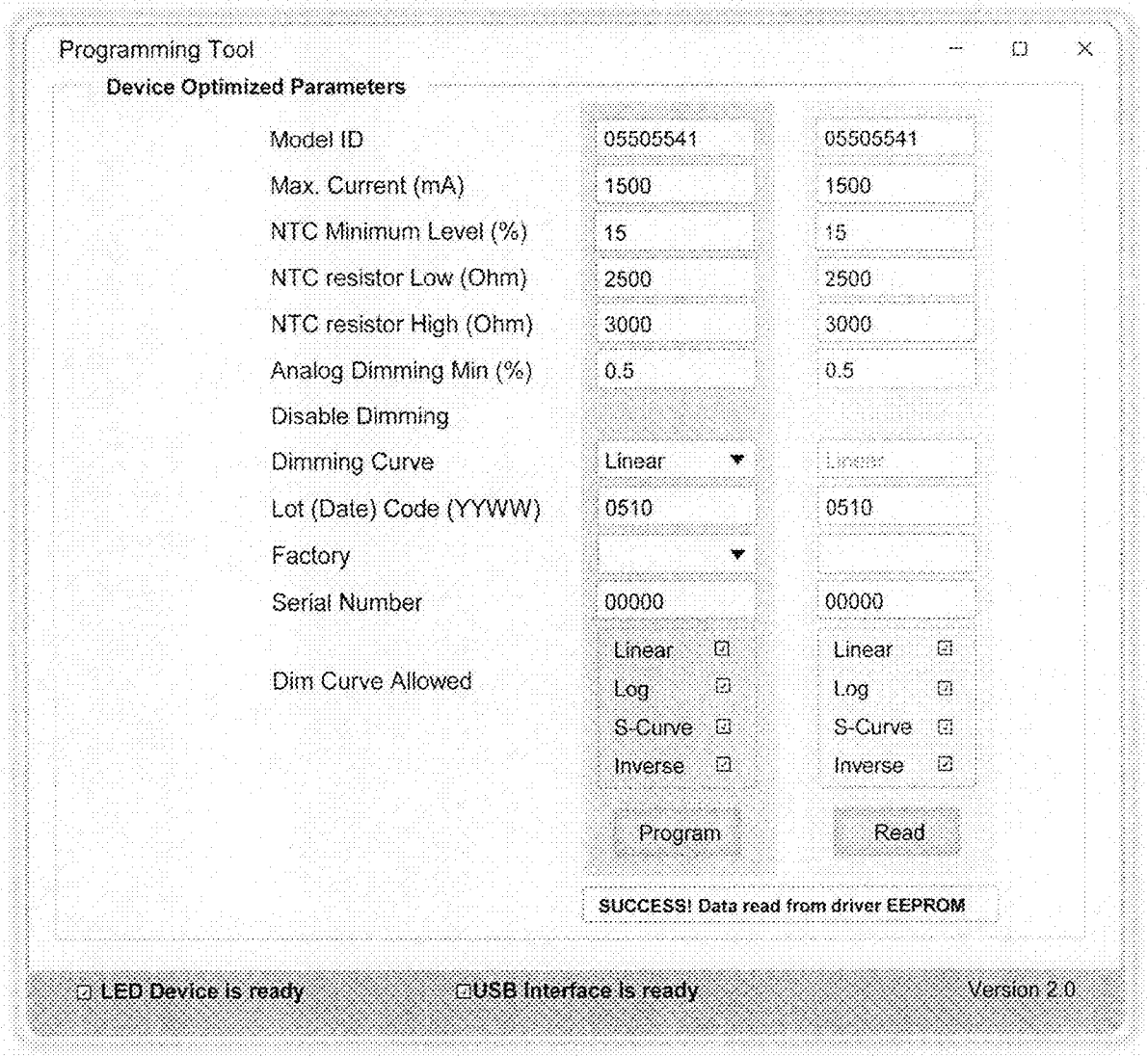
FIG. 5 is a sample GUI screen.
Figure 6:
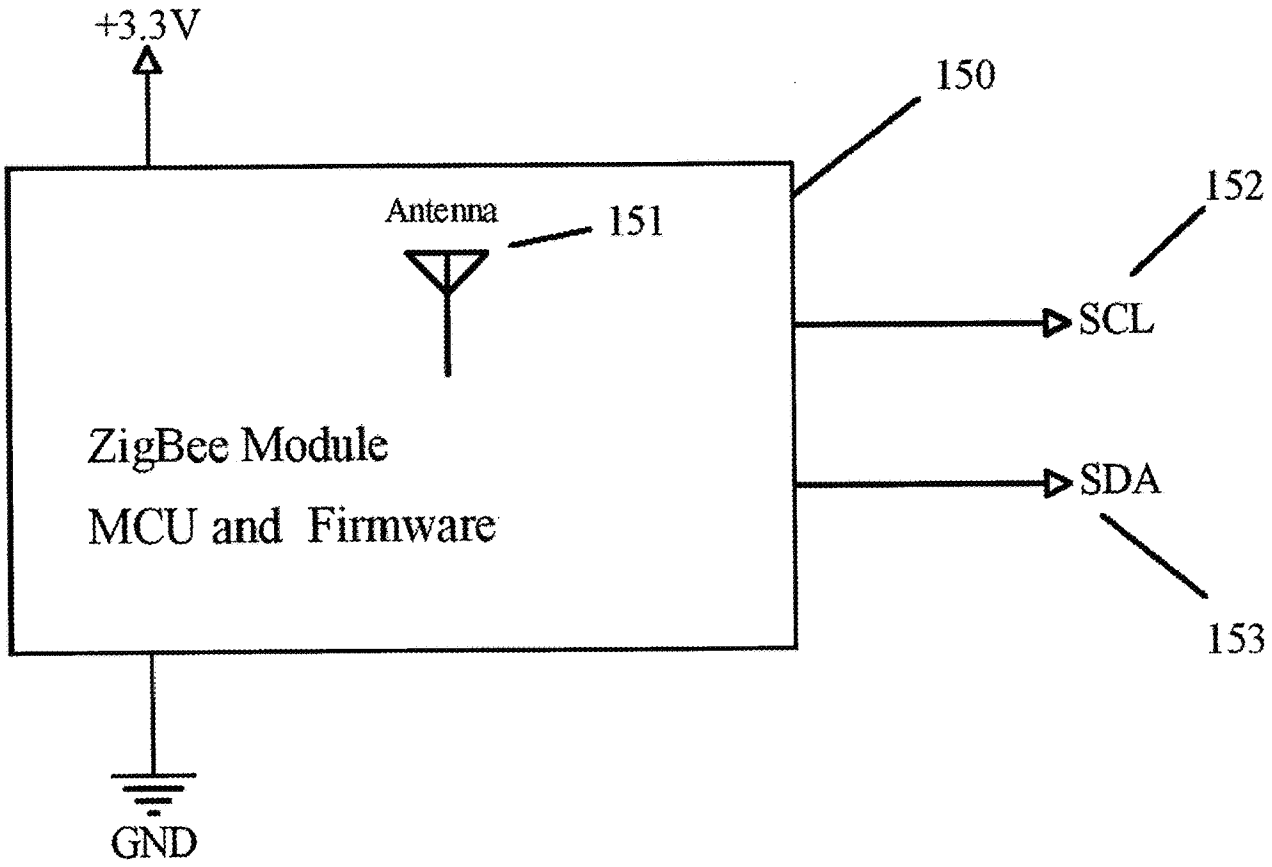
FIG. 6 is a wireless Mesh Network ZigBee Module.

Programming the EEPROM. The microprocessor U4 has an EEPROM U5 that provides a data table storage of factory default and user programmable parameters. The programmable parameters can be read and modified, then reprogrammed by a graphic user interface (GUI) software program via a universal serial bus port on a computer with a USB to I2C interface converter. The USB-to-I2C interface converter outputs I2C communication signals as SDA and SCL (FIG. 3) to the microcontroller to alter the programmable data in the EEPROM data area. A graphic user interface software can communicate with the LED driver to read existing programmable parameters. The microprocessor EEPROM data table stores programmable parameters including a maximum LED current parameter that is no higher than the buck converter hardware design limit and an Rset value or GUI set maximum value. FIG. 5 shows a screenshot of this GUI display. FIG. 3 shows an interface port CN3 which serves as a GUI programming port. The programming signals are connected to the SDA and SCL nodes. Programmable parameters can also be read and modified, then reprogrammed by a remote wireless graphic user interface (GUI) software program via the internet. For this purpose a Zigbee interface module (FIG. 6) is also joined to nodes SDA and SCL. The wireless GUI program is run at a remote location, and has similar computer screens as the wired USB-to-I2C interface GUI. However, the wireless GUI commands are communicated via the Ethernet cable to a proprietary website on the Internet. This wireless GUI website will first ask the user to set up the ZigBee mesh network by searching for the programmable LED driver with mesh network ZigBee module installed, or ZigBee LED driver for short. The ZigBee LED driver must be powered up and within the wireless range of a ZigBee Gateway device. This ZigBee Gateway device is also connected to the Internet. The remote wireless GUI can search and find the ZigBee LED driver, and then give a "joint" command to complete the ZigBee communication channel. Once the ZigBee communication channel is linked properly, then the wireless GUI program can perform all the programming functions that the USB-to-I2C GUI does. As used in this disclosure, GUI means either wired USB-to-I2C GUI or wireless ZigBee GUI. Although these 2 interfaces are wired and wireless respectively, they both do the same programming function once the wireless setup of the ZigBee communication channel is completed. FIG. 6 shows the block diagram of the ZigBee module 150. ZigBee module 150 contains a commercial ZigBee enabled microprocessor (MCU) and an antenna 151. The MCU is powered by the available system +3.3 V DC voltage. The ZigBee enabled MCU has a built-in antenna amplifier and receiver, which can connect to the Antenna 151 directly. A proprietary firmware is loaded into the MCU, which can establish wireless GUI 2-way communication, giving the programming commands and reporting status back to the ZigBee Gateway and the wireless GUI. When the programming commands are received, the firmware in the ZigBee enabled MCU will convert them into standard I2C communication format on the Serial Data SDA 153 and Serial Clock SCL 152 wires. The new commands or data can then be loaded into or read out from the I2C Bus of EEPROM U5 104, where the programmable LED driver's default and user defined setting data are stored.

Programming the driver with external resistors. The negative temperature coefficient (NTC) resistor (133 in FIG. 4) controls programmable temperature derating. GUI Programmable values for NTC are temperature derating start (Ohms), temperature derating end (Ohms) and minimum output level (% of max). The microcontroller (MCU) continuously reads the resistance value of the NTC on the input connector and uses the parameters stored in the EEPROM to throttle back the output current and prevent excessive temperatures. If an NTC resistor is not installed, or is installed but the value is higher than default maximum 6.3K then no temperature response exists. The resistor Rset (123 in FIG. 4) determines the maximum possible output current. If Rset is less than 8.3K ohms, the output current is determined by the value of Rset and the 0-10 V analog control signal at the input. If Rset is greater than 8.3K ohms, the maximum current assumes a value set on the GUI. (FIG. 5). When the ambient temperature increases and the NTC resistance value drops below the upper value set by the GUI, then the microcontroller reduces the LED output current into a temperature derating mode according to the internal EEPROM data and MCU formula, based on the NTC resistance value. The NTC temperature derating is programmable via the GUI, to select an upper resistance where the LED current begins to fall back and a lower resistance where the LED current is held on at the GUI programmed minimum value.

The shutdown function. The UDIM pin (U1, FIG. 2) is used in the present invention for an overvoltage or shutdown function. The PWM_Dim signal 108 is used to shutdown the LED output by setting the PWM_Dim signal 108 at logic 0 or 0 VDC continuously when the voltage on U4 105 pin PA4 (FIG. 3) is too high, which means LED output voltage at +Vout is in a state of overvoltage. This could happen, for example, if the LED load went open circuit. The +Vout voltage is divided down using a pair of resistors Rvout3 118 and Rvout4 119, and filtered by a low-pass RC filter comprising resistor Rvout5 120 and capacitor Cout_sense 121. The resulting signal Vout_Sense 122 is fed to the microprocessor U4 105 analog input pin PA4.

The GUI screen and its programming. A sample GUI screen on a programming tool, as seen in FIG. 5, can have a screen for device optimized parameters or variables. For example, parameters or variables can be read from the EEPROM on a right-hand column when the user clicks on a read button in the right-hand column, and then the user can change the parameters or variables on a left-hand column when a user clicks on a program button on the left-hand column. A variety of different parameters or variables can include a model ID, and maximum current in milliamps, and NTC minimum level, an NTC resistor low setting in Ohms, an NTC resistor high setting in Ohms, an analog dimming minimum percentage, a checkbox for disabling dimming, a selection drop-down menu for selecting a dimming curve, a lot and date code, a factory identifier, a serial number, and also have checkboxes for the dimming curves allowed. The checkboxes can include a checkbox for a linear dimming curve, a checkbox for a logarithmic dimming curve, a checkbox for an S-curve dimming curve, and a checkbox for an inverse dimming curve. The programming tool can also have an output message field such as providing a message such as "SUCCESS! Data read from driver EEPROM" when data is successfully read from the EEPROM. Indicators can also be provided in the programming tool window at a bottom of the programming tool GUI screen. For example the indicators could indicate that the LED device is ready, or indicate that the USB interface is ready. The version number can be placed in the lower right-hand corner to indicate the version of the programming tool, such as version 2.0.

Programming the programmable LED driver. The present invention programmable LED driver has industrial standard 0-10 VDC analog dimming with the additional following nine programming features: (FIG. 5) First, a user can provide a preset maximum LED current when analog dimming voltage Vdim=10 V or some other preselected max Vdim voltage, using the GUI. Secondly, the GUI can be used to preset a minimum LED current as a percentage of the maximum LED current when the analog dimming voltage Vdim=0 V or some other preselected minimum Vdim voltage. Third, with the maximum LED current already set using the GUI, the LED maximum current can be adjusted easily by users with only an external current set resistor Rset 123. Fourth, Rset has an override feature. If the Rset 123 resistance is greater than a certain value, such as greater than 8.3K OHM or open where Rset 123 is not installed, then the previously selected maximum LED current from the GUI is selected. Alternatively, if an Rset 123 resistance value is lesser than a certain value, such as lesser than 8.3K OHM, the programmable maximum output current function, determined by the Rset value and internal Firmware EEPROM data, overrides the GUI Iout settings stored in the EEPROM. This programmed maximum output current value is then controlled by the 0-10 V input from 0% to 100% Output. Fifth, the 0-10 VDC analog dimming Vdim_Vs_LED current is user selectable via the GUI with several options, such as linear, logarithm, S-Curve or Inverse profiles. Sixth, a user can disable the dimming function using the GUI. Seventh, with an external negative temperature coefficient (NTC) resistor, the user can program the LED Driver overheat drawback curve, from starting drop LED current to lowest LED current, to protect both the LED driver and the LED lamps. This is a temperature "derating" programmable feature. Seventh, a built-in default NTC derating curve is provided so that the user just needs to select a proper NTC resistance value and proper resistance at desired fall back and minimum temperature to program the desired temperature derating curve. Eighth, the user can also change the default NTC curve via the GUI, by selecting an NTC minimum resistance and maximum resistance. Ninth, the corresponding NTC minimum LED current (in % ratio to maximum LED current) is also programmable via the GUI.

The Sensor Inputs (FIG. 4) FIG. 4 shows the input signals from the sensors. At the top is shown the biasing arrangements for the NTC temperature sensing resistor. A Dntc1 Protection Diode 139 works with the Rntc1 Pull up resistor 138 to pull up to 3.3 V. A NTC negative temperature coefficient resistor 133 is an optional user provided item as a temperature sensor for the system. Cntc 140 is a noise filter for the NTC_P output to the microprocessor 140. In the center of FIG. 4, LED current set resistor Rset 123 is a user supplied resistor that sets the maximum value of the LED output current. Rrset1 pull up resistor 124 pulls up Rset 123 at connector J7 to 3.3 VDC voltage. Rrset2 low-pass resistor 125 works with Crset low-pass capacitor 126 to make a low-pass filter to filter noise pick up that may have become coupled into dimming signal 137. At the bottom of FIG. 4 is shown the circuit which supplies the 0-10 V dimming signal to the external dimmer. The external dimmer sinks this current and limits the current to a voltage which is detected as the dimming signal. Radim2 resistor voltage divider 112, Radim3 resistor voltage divider 113 and Cadim noise filter 114 provide the voltage dividing and signal cleaning function for the signal analog dimming 115 which is applied to the microprocessor pin PA1. Analog Dim (0-10 VDC) 111 should not to be confused with FIG. 2 "Analog Dim" signal 107, which is the output on U4 105 pin "PB1". FIG. 4 connector J8 is "Analog Dim (0-10 VDC)", the industrial standard 0 VDC min and 10 VDC max dimming voltage. The 10 VDC is too high for a 3.3 VDC microcontroller. Adapting the voltage requires dividing it down by resistors Radim2 112 and Radim3 113.

Although the invention is described as using a Zigbee wireless interface, any kind of wireless interface can be used to realize the benefits of this invention. A microprocessor using 3.3 V is described, but equally microprocessors using any other voltage can be used. A specific kind of buck converter chip is described, however the same principles can be applied to any of the commonly available buck converter chips. Even though the use of EEPROM is described, the benefits of the invention can be equally obtained using other kinds of memory devices, for example OTP (one time programmable) devices or EPROM devices. The present invention is not limited not by the specific disclosure of the embodiments, but only by the appended claims that define the scope of the invention. Persons of ordinary skill in the art can appreciate obvious modifications to the specific embodiments described above without departing from the spirit of the invention as described by the claims below.

The invention claimed is:

1. An LED driver with AC input and DC output, comprising:

a) a buck converter using a buck converter chip;

b) a microprocessor, wherein said buck converter has its output current controlled by the microprocessor;

c) a DC output current, wherein the microprocessor selects a value of the DC output current;

d) an analog dimming input signal, wherein the microprocessor selects the value of the DC output current according to a value of the analog dimming input signal which has been translated using a predetermined programmable relationship between the input signal and the output current, wherein the output current is scaled according to a value of a resistor connected to the microprocessor.

2. The LED driver of claim 1, wherein the microprocessor is connected to an NTC resistor so that the DC output current is reduced in response to the ambient temperature.

3. The LED driver of claim 2, wherein the microprocessor is associated with an EEPROM and is connected to a GUI port so that parameters of the dimming response stored in the EEPROM can be modified.

4. The LED driver of claim 3, wherein data stored in the EEPROM includes at least one predetermined relationship between the analog dimming signal and the DC output current.

5. The LED driver of claim 3, wherein parameters stored in the EEPROM determine the manner in which the output of the driver is modulated in response to the temperature sensed by a NTC resistor.

6. The LED driver of claim 2, wherein the microprocessor is associated with an EEPROM and is connected to a Zigbee module so that the parameters of the dimming response stored in the EEPROM can be modified wirelessly.

7. The LED driver of claim 6, wherein data stored in the EEPROM includes at least one predetermined relationship between the analog dimming signal and the DC output current.

8. The LED driver of claim 6, wherein the parameters stored in the EEPROM determine the manner in which the output of the driver is modulated in response to the temperature sensed by the NTC resistor.

* * * * *